United States Patent [19]

Yavari

[11] Patent Number: 4,713,953

[45] Date of Patent: Dec. 22, 1987

[54] SUPERPLASTIC FORMING PROCESS

[75] Inventor: Parviz Yavari, Torrance, Calif.

[73] Assignee: Northrop Corporation, Hawthorne, Calif.

[21] Appl. No.: 806,894

[22] Filed: Dec. 9, 1985

[51] Int. Cl.[4] ..... B21D 26/02

[52] U.S. Cl. ..... 72/60; 72/54; 72/709; 29/421 R

[58] Field of Search ..... 72/38, 54, 56, 58, 63, 72/60, 709; 29/421 R

[56] References Cited

U.S. PATENT DOCUMENTS 4,181,000 1/1980 Hamilton et al. ..... 72/60
4,233,829 11/1980 Hamilton et al. ..... 72/60
4,233,831 11/1980 Hamilton et al. ..... 72/60

*Primary Examiner*—Robert L. Spruill
*Assistant Examiner*—David B. Jones
*Attorney, Agent, or Firm*—Terry J. Anderson; Robert B. Block

[57] ABSTRACT

Heated superplastic material is deformed using gas pressure which forces the material into a die cavity. Improved three dimensional models for deforming superplastic materials are based upon spherical shapes penetrating the die cavity which is approximated by one of two different rectangular box models. The three dimensional and box models produced radius and thickness equations from which an accelerated gas pressure versus time profile and a minimum thickness value are calculated. The gas pressure deforms the superplastic material at the maximum possible strain rate without rupturing thereby reducing the speed at which parts are formed. Die frictional effects and variable flow stress phenomena are included into the pressure versus time profile computation and thickness equations so as to improve the speed and accuracy of the superplastic forming process.

15 Claims, 9 Drawing Figures

FIGURE 8

| STAGE | R/C | DEEP BOX RADIUS AND THICKNESS EQUATION TABLE |
|---|---|---|
| $t_1$ | R | $R^2 = \left(\frac{L^2+W^2}{4W}\right) + \left(\frac{L^2-4h^2}{8h}\right)^2$ |
| $t_1$ | $T_c$ | $\frac{T_c}{T_o} = \frac{\frac{\pi W^2}{16} + \frac{WL}{4} - \frac{W^2}{4}}{\frac{W^2+4h^2}{8h}\left[\frac{\pi}{2}h + (L-W)\tan^{-1}\frac{h}{W/2}\right]}$ |
| $t_2$ | R | $R^2 = \left(\frac{L^2+W^2}{4W}\right)^2 + \left(\frac{L^2-W^2}{4W}\right)^2 = \frac{L^4+W^4}{8W^2}$ |
| $t_2$ | $T_c$ | $\frac{T_c}{T^*} = \left(\frac{\frac{\pi}{2}WL + \pi WV + 4(L-W)f}{\frac{\pi}{2}WL + 4(L-W)f}\right)^{-\frac{\pi W + 2L - 2W}{\pi W}}$ |
| $t_3$ | R | $R^2 = \left(\frac{W^2+L^2}{4W}\right)^2 + \left(r + \frac{L^2-W^2}{4W}\right)^2$ |
| $t_3$ | $T_c$ | $\frac{T_c}{T^*} = \frac{\frac{\pi}{8}WL - \frac{1}{8}\pi r^2 - L - W/2\, r + f(L-W)}{\frac{\pi}{2}\left(\frac{W}{2}-r\right)^2 + \frac{\pi^2}{4}r\left(\frac{W}{2}-r\right) + \frac{\pi}{2}\left(\frac{W}{2}-r\right)\frac{L-W}{2} + \frac{\pi W r}{4} + \frac{1}{8}\pi r^2 + \frac{L-W}{2}r + \left(\frac{\pi}{2}r + L - W\right)f}$ |
| $t_4$ | R | $R^2 = 2\left[\frac{\frac{W^2}{4} + \left(\frac{L}{2}-m\right)^2}{W}\right]^2$ |
| $t_4$ | $T_c$ | $\frac{T_c}{T^*} = \frac{\frac{1}{8}\sqrt{L^2+W^2}\sqrt{\frac{W^2}{4} + \frac{W^2 \times L^2}{16(W^2+L^2)}} + \frac{f}{4}\sqrt{W^2+L^2} + f\sqrt{\frac{W^2}{4}+\frac{L^2}{16}}}{\frac{1}{4}\sqrt{\frac{W^2}{4}+\left(\frac{L}{2}-m\right)^2}\sqrt{\frac{W^2}{4}+\left(\frac{L}{2}-m\right)^2}\cdot\sqrt{\frac{W^2}{4}+\frac{W^2(L/2-m)^2}{16\left[\frac{W^2}{4}+(L/2-m)^2\right]}} + \frac{W\sqrt{5}}{4}f - \frac{3Wm}{32} + \frac{f}{2}\sqrt{\frac{W^2}{4}+\left(\frac{L}{2}-m\right)^2}} + \frac{W\sqrt{5}}{4}f + \frac{f}{2}\sqrt{W^2+\left(\frac{L}{2}-m\right)^2} + \frac{3Wm}{32}$ |
| $t_5$ | R | $R = (W/2 - X)\sqrt{2}$ |
| $t_5$ | $T_c$ | $\frac{T_c}{T^*} = \left[\frac{(W/2-X) + 13.1f}{W/2 + 13.1f}\right]^{2.58} \frac{W/2}{W/2-X}$ |

FIGURE 9

| STAGE | R/C | SHALLOW BOX RADIUS AND THICKNESS EQUATION |
|---|---|---|
| $t_1$ | R | $R^2 = \left(\frac{L^2+W^2}{4W}\right)^2 + \left(\frac{L^2-4h^2}{8h^2}\right)^2$ |
| $t_1$ | $T_c$ | $\frac{T_c}{T_o} = \frac{\frac{\pi W^2}{16} + \frac{WL}{4} - \frac{W^2}{4}}{\frac{W^2+4h^2}{8h}\left(\frac{\pi}{2}h + (L-W)\,TAN^{-1}\frac{h}{W/2}\right)}$ |
| $t_2$ | R | $R^2 = \left(\frac{L^2+W^2}{4W}\right)^2 + \left(\frac{\frac{L^2}{4} - H^2 - V^2 + V\frac{W^2-L^2}{2W}}{2h}\right)^2$ |
| $t_2$ | $T_c$ | $\frac{T_c}{T^*} = \left(\frac{\pi}{16}W^2 + \frac{\pi}{4}H^2 + \left(\frac{W^2}{8H} + \frac{H}{2}\right)(L-W)\,TAN\,\frac{2H}{W} - \pi\frac{V^2}{8} - V\frac{L-W}{4}\right)\left(\frac{\pi}{2}RH + \frac{\pi^2}{4}RV - \frac{\pi}{2}RV\,SIN^{-1}\frac{R-H}{R} + \frac{(W/2-V)^2+H^2}{H}\,\frac{L-W}{2}\,TAN^{-1}\frac{H}{W/2-V} + \pi\frac{V^2}{8} + V\frac{L-W}{4}\right)^{-1}$ |
| $t_3$ | R | $R^2 = \left(\frac{W^2+L^2}{4W}\right)^2 + \left(\frac{W^2+L^2}{4W} - H + r\right)^2$ |
| $t_3$ | $T_c$ | $\frac{T_c}{T^*} = \frac{\frac{\pi H^2}{2} + \frac{\pi^2}{4}H\left(\frac{W}{2}-H\right) + \frac{\pi}{4}H(L-W) - \frac{1}{8}\pi\left(\frac{W}{2}-H+r\right)^2 + \frac{L}{8}\pi\left(\frac{W}{2}-H\right)^2}{\frac{\pi}{2}(H-r)^2 + \frac{\pi^2}{4}(H-r)\left(\frac{W}{2}-H+r\right) + \frac{\pi}{4}(H-r)(L-W) + \frac{\pi W r}{4}} \frac{-\frac{(L-W)}{2}r + \frac{\pi}{2}\left(\frac{W}{2}-H\right)f + (L-W)f}{+\frac{1}{8}\pi\left(\frac{W}{2}-H+r\right)^2 - \frac{1}{8}\pi\left(\frac{W}{2}-H\right)^2 + \frac{L-W}{2}r + \frac{\pi}{2}\left(\frac{W}{2}-H+r\right)f + (L-W)f}$ |
| $t_4$ | R | $R^2 = 2\left[\frac{\frac{H^2}{4} + \left(\frac{L}{2}-m\right)^2}{2H}\right]^2$ |
| $t_4$ | $T_c$ | $\frac{T_c}{T^*} = \frac{\frac{1}{8}\sqrt{L^2+16H^2} - \sqrt{H^2 + \frac{H^2 \times L^2}{16^2+L^2}} + \frac{f}{4}\sqrt{16H^2+L^2} + f\sqrt{H^2+L^2/16}}{\frac{1}{4}\sqrt{4H^2+\left(\frac{L}{2}-m\right)^2}\sqrt{H^2 + \frac{2\left(\frac{L}{2}-m\right)^2}{\left[4H^2+\left(\frac{L}{2}-m\right)^2\right]}}} \frac{+\frac{H\sqrt{5}}{2}f - \frac{3Hm}{16}}{+\frac{f}{2}\sqrt{4H^2+\left(\frac{L}{2}-m\right)^2}} + \frac{W\sqrt{5}}{4}f + \frac{f}{2}\sqrt{W^2+\left(\frac{L}{2}-m\right)^2} + \frac{3Wm}{32}$ |
| $t_5$ | R | $R = (H-X)\sqrt{2}$ |
| $t_5$ | $T_c$ | $\frac{T_c}{T^*} = \left[\frac{(H-X)+13.1f}{H+13.1f}\right]^{2.58}\frac{H}{H-X}$ |

SUPERPLASTIC FORMING PROCESS

BACKGROUND

Superplastic forming processes are known in the art to be a viable commercial method of forming metals beyond the limitations of conventional sheet metal forming processes. Superplastic sheets of metals are generally deformed by a single sided gas pressure applied against the sheet of metal positioned above a die cavity. A pure inert gas is used for pressurization and used to prevent oxidation or impurity contamination of the sheet metal during the pressurized forming process. Superplastic sheet metal, at an elevated temperature, is disposed above the die cavity with a gas pressure directed against the sheet metal towards the die cavity so to deform the sheet metal into a part defined by the die cavity topography.

Two phase materials with a stable fine grain size and with a grain growth impedance component, such as Ti-6AL-4V at their superplastic temperature, exhibit superplastic forming characteristics. These sheet metal materials typically have low flow stresses at high temperatures suitable for superplastic deformation. The superplastic material is elongated at relatively low strain rate preventing excessive and variable thinning or premature rupturing of the material during the formation of complicated parts. However, a low strain rate decreases the speed at which the superplastic material is deformed during the forming process.

The material defines the superplastic temperature at which the sheet metal is deformed. A gas pressure versus time profile applied against the sheet metal is critical to the economic success of the forming process given a particular die cavity topography. As the time of the forming process is reduced, the total cost per part is reduced. Increased pressure upon a deforming superplastic material increases the deformation rate. Thus, a lower and longer pressure versus time profile of a superplastic deformation process increases the cost of each formed part.

In determining the pressure versus time profile for a given die cavity topography, two dimensional models were developed. The two dimensional models are used to approximate the form of the material during the forming process. However, the die cavity is a three dimensional form. As such, the two dimensional models and corresponding equations are only a gross approximation of the actual form of the material during the forming process. Consequently, the pressure versus time profile generated by equations derived from the two dimensional model are grossly inaccurate and conservative resulting in increased processing time for a particular formed part.

The two dimensional equations also did not take in to account other real phenomena which occur during the forming process. The two dimensional models and equations used to develop the pressure versus time profile did not include the die cavity surface friction. Die cavity surface friction relates to the material moving tangentially against the surface of the die cavity during the forming process.

Variable flow stress relates to the flow of metal as the material expands and elongates into the die cavity during the forming process. The two dimensional models and the corresponding equations were developed to generate the pressure versus time profile which equations did not include the effects of the variable flow stress of the superplastic material during deformation, but rather assumed for computational purposes that the flow stress was a constant. An equation using a constant flow stress is not as accurate as one using a variable flow stress.

The exclusion of the die friction effects and the exclusion of variable flow stress effects further reduces the accuracy of the two dimensional models and the derived equations in terms of providing an accelerated pressure versus time profile and further reduces the ability to predict the thickness at any point on the material and at any time during the forming process.

To avoid rupturing and excessive thinning, the two dimensional models and corresponding equations were generally conservative. The two dimensional model and the corresponding equations used a relatively low strain rate. Consequently, the time to form a particular part was relatively long. Also, the equations could not predict with much accuracy the thickness of the part at any point during the forming process. These and other disadvantages are reduced using an improved superplastic forming method which includes the die friction effects, the variable stress effects and based upon three dimensional models.

SUMMARY

An object of the present invention is to improve the superplastic forming process.

Another object of the present invention is to provide a method of computing the minimum thickness at any point on a deforming piece of sheet metal during the forming process.

Yet a further object of the present invention is to improve the method of computing a pressure versus time profile for a given die cavity topography so as to increase the speed of the superplastic forming process thereby reducing the time in which parts are formed.

Still another object of the present invention is to improve the method of computing the pressure versus time profile for a given die cavity topography by using three dimensional models including the effects of die cavity length in a third dimension, the effects of corner radii in the third dimension, and die friction effects and by use of a variable flow stress.

Still a further object of the present invention is to improve the method of computing the pressure versus time profile for a given die cavity topography by using three dimensional model based upon superplastic material spherically deforming into a die cavity which is approximated by one of two general box shapes, which material passes through five different modeling stages during the forming process.

A method oi computing an accelerated high-pressure versus time profile and a method of computing the minimum thickness of a superplastic formed part are based upon one of two general box shapes. As a first approximation, the topography of any particular die cavity is assumed to be a rectangular box having a box cavity defined by a bottom, four side walls, a height, a width and a length. The length is considered a normalizing dimension. A shallow box shape and a deep box shape are used depending on which more closely approximates the actual shape of a corresponding die cavity. A shallow box is defined by when the width divided by the height is greater than two. A deep box is defined by when the width divided by the height is less than two.

As another approximation, the material is assumed to take on the form of a sphere at all times while being deformed into the box shape except for those portions of the material which are in surface contact with either the side walls or the bottom of the box cavity. Those portions of the material not in contact with either the bottom or the side walls of the box cavity, that is, the spherically curved portions suspended in the box, are assumed to have the same curved thickness $T_c$.

During the forming process, computation of the pressure and the curved thickness $T_c$ occurs in stages during the forming process. Two sets of equations were developed for each of the two different box shapes. One set of equations computes the curved thickness $T_c$ of the spherically suspended material in the box during the forming process as a function of the box geometry and die frictional effects. The other set of equations computes the radius R of the spherically suspended material during the forming process. Each set of equations comprises five separate equations corresponding to five consecutive stages which occur in sequence during the forming process. Each stage is defined by the extent to which the material has penetrated the box cavity.

The thickness and radius equations were developed assuming a sphere expanding into the box cavity during the forming process. The basis of the pressure versus time profile is derived from a well know pressurized sphere equation which sets the pressure P equal to twice the flow stress S multiplied by the quotient of the curved thickness $T_c$ divided the sphere radius R. Thus, $P=[2ST_c]/R$. Both the radius R and the thickness $T_c$ are calculated based upon the spherical model expanding into the box cavity, and thus, are functions of the model geometry and the box cavity geometry. The curved thickness $T_c$ is also a function of the die friction effects and the thickness $T_c$ can also be expressed as a function of time.

A heated superplastic piece of sheet metal material is placed above the box cavity, which material has an initial area $A_o$ defined by the width multiplied by the length and having an initial thickness $T_o$. Gas pressure P is applied against the heated superplastic material forcing the material into the box towards the bottom of the box through the height dimension.

At the beginning of the forming process, the material is in a rectangular sheet prescribed by the area $A_o$ and the thickness $T_o$. An initial volume $V_o$ of the sheet metal material is always equal to the total volume V which does not change during the forming process. As the material is deformed, the total volume V remains a constant and equal the area total A multiplied by the average thickness T.

The volume is equal to a curved volume $V_c$ of spherically suspended material in the box cavity and a touching volume $V_t$ of the material touching the bottom or side walls of the box cavity. The thickness of the material touching the bottom and side walls is equal to the curved thickness $T_c$ of the spherical suspended material at the time and at the point the spherically suspended material touches the bottom or side wall. Hence, the touching thickness $V_t$ decreases down the sides walls and decreases from the center of the bottom to the edges of the bottom during the forming process.

The initial Volume $V_o$ is equal to the initial area $A_o$ multiplied by the initial thickness $T_o$. Thus, $V_o=A_oT_o$. This initial volume $V_o$ is also equal to the touching volume $V_t$ of the material touching the bottom or side walls plus the curved volume $V_c$ of the spherical suspended material in the box cavity. Hence, $V_o=V_c+V_t$.

The curved thickness $T_c$ of the spherically suspended material can be computed as $T_c=[A_oT_o-V_t]/A_c$ at any time during the forming process where $A_c$ is the area of the spherical suspended material. The thickness $T_c$ can be computed during the forming process based upon volumetric relationships and the box geometry and model geometry.

The pressure equation has been modified to include a variable flow stress, which pressure equation is $P=[2ST_c]/R$ where S is the flow stress. The improvement is setting the flow stress S equal to a constant K, which was found experimentally, multiplied by the square root of a strain rate D, which was also found experimentally and is equal to a constant value, multiplied by the square root of a strain E which varies during the forming process. Accordingly, the variable stress pressure equation is $P=[2KD^{\frac{1}{2}}E^{\frac{1}{2}}T_c]/R$.

As yet another improvement of computing the pressure versus time profile, the die friction effects are included into the curve thickness equations. As a means to include a die friction effect, it is assumed that a differential volumetric portion $V_d$ of the touching volume $V_t$ of material touching the side walls or bottom of the box cavity will flow into the curved volume $V_c$ of the spherically suspended material. This differential volumetric portion $V_d$ is equal to another constant f, which was also found experimentally, multiplied by the curved thickness $T_c$ of the spherically suspended material multiplied by a circumferential or linear perimeter M of touching material. Hence, $V_d=fT_cM$. The perimeter M is that total distance on the bottom or side walls of the box cavity where the touching material connects to the curved material.

Thus, the die frictional effects are realized by a change in volume $V_d$ between the touching volume $V_t$ and spherical volume $V_c$. Since the sets of equations relate to the geometries of the spherical model and since the curved thickness $T_c$ can be determined at any point at any time, the change in volume $V_d$ can also be computed so as to adjust the curved thickness $T_c$ and the curved volume $V_c$ accordingly.

The three dimensional models provide more accurate radii and curved thickness equations the later of which includes die friction effects. The curved thickness $T_c$ also varies with time during the forming process. As such, the curved thickness $T_c$ can be computed based upon the geometries of the box and spherical models or based upon time.

The pressure equation which is a function of radii and curved thickness $T_c$ has been modified to include variable flow stress effects. The strain rate D is set at a constant maximum possible value while still preventing rupturing or excessive thinning during deformation. Thus, a particular part is formed in a minimum amount of time while the minimum thickness, that is the curved thickness $T_c$ can be computed at any time and at any point during the forming process. These and other advantages will become more apparent in the following description of the preferred embodiment.

DRAWING DESCRIPTIONS

FIG. 8 is a table of radii and curved thickness equations for the deep box cavity.

FIG. 9 is a table of radii and curved thickness equations for the shallow box cavity.

PREFERRED EMBODIMENT

Figure 1:
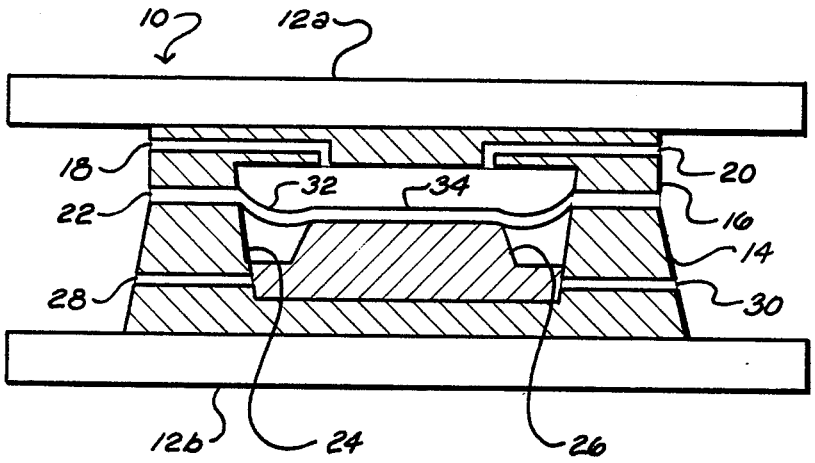
FIG. 1 depicts a superplastic piece of sheet metal being deformed is a die cavity.

Referring to FIG. 1, a superplastic deforming apparatus 10 has heated ceramic platens 12 clamping together a die fixture having a base portion 14 and a top portion 16. The top portion 16 has a gas inlet channel 18 and a gas outlet channel 20 both of which communicates a pure inert gas which is pressurized and which applies a pressure force against a piece of superplastic sheet material 22. The superplastic material 22 is shown to be in a state of partial deformation.

The die base portion 14 has a cavity 24 into which may be placed an insert 26. Leakage channels 28 and 30 are used to communicate gas which is forced out of the die cavity 24 as the superplastic material 22 is deformed. The cavity 24 and the insert 26 combine forming a cavity topography over which the superplastic material 22 will be deformed by the end of the forming process.

The heated ceramic platens **12*a* and 12*b* are in thermal contact with the die portions 14 and 16 so as to conduct heat to the die portions 14 and 16 which in turn heat the superplastic material 22. The superplastic material 22 is heated to a high homologous temperature above one half of the absolute melting point of the superplastic material 22. The superplastic material 22** may be, for example, a Ti-6Al-4V alloy which is a stable fine grain size two phase mixture exhibiting superplastic properties at approximately 1650 degrees fahrenheit.

Figure 2:
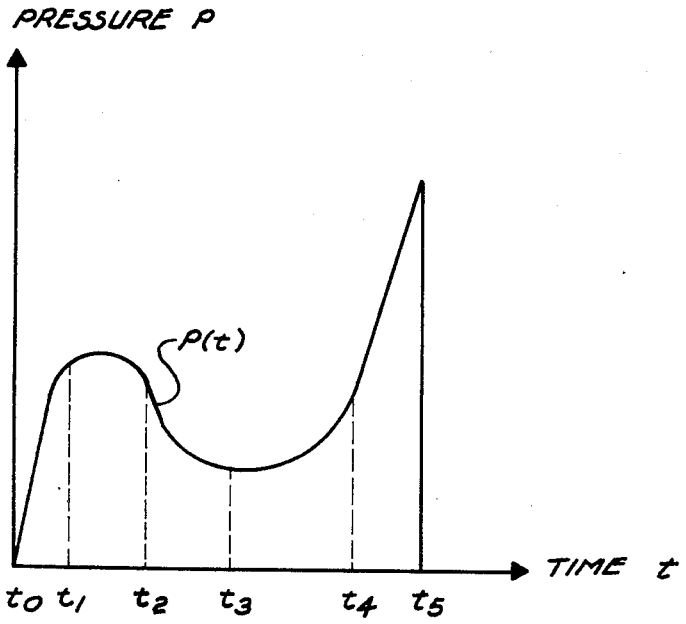
FIG. 2 depicts a typical pressure versus time profile.

Referring to FIGS. 1 and 2, gas pressure P of the inert gas, which may be for example Argon, is applied against the superplastic material 22 through the inlet gas channel 18 and the outlet gas channel 20. The gas pressure P follows a pressure versus time profile P(t) which is applied through five different stages represented by time segments $t_1$ through $t_5$.

The applied gas pressure P is set so that the superplastic material 22 expands into the die cavity 24 over the cavity topography at a constant maximum strain rate D so as to reduce the time necessary to form a part defined by the cavity topography.

The superplastic material 22 has a suspended portion 32 and a touching portion 34, the later of which touches a portion of the cavity topography. The suspended portion 32 has a curved thickness $T_c$ which decreases as the material 22 forms a part defined by the cavity topography during the forming process. The suspended portion 32 generally assumes a spherical shape having a radius R during the forming process.

When deforming the superplastic material 22 in pressurized dies, the deformation of the material 22 is at rate that is dependent upon the gas pressure P applied against the material 22. Typically, the material 22 is deformed producing a spherical curvature of the material 22 as it penetrates and fills the cavity of the die. Generally, the gas pressure P applied to the material 22 is equal to twice the flow stress S multiplied by the quotient of the curved thickness $T_c$ of the suspended portion 32 of the material 22 divided by a spherical radius R. Hence, for a spherical deformation, $P=[2ST_c]/R$.

It is known that a strain E upon a given material is equal the difference in its present length L minus an initial length $L_o$ with this difference divided by the initial length $L_o$. Hence, $E=[L-L/L_o]/L_o$. The length L may be considered in any one of the three dimensional axes. Another way to express the strain E upon a given material is that the strain E is equal to the natural log of the quotient of a present thickness divided by an initial thickness $T_o$. Hence, $E=\ln[T/T_o]$.

The strain rate D upon a given material is equal to the time rate of change of the stain E. Hence, $D=dE/dt$. Superplastic materials generally exhibit a strain E (vertical axis) versus strain rate D (horizontal axis) curve above which the superplastic materials are likely to rupture from excessive strain and below which the superplastic materials are not likely to rupture during deformation of the superplastic materials.

The strain E versus strain rate D curve typically has a maxima at which the corresponding superplastic material may be stretched and elongated at its fastest rate at its highest strain without rupturing and without excessive thinning. The constant maximum strain rate D was found experimentally to be 0.0008 per second for Ti-6Al-4V at the maxima.

The pressure equation has been modified to include a variable flow stress, which pressure equation is $P=[2ST_c]/R$. The flow stress S is generally defined as a force upon a cross sectional area of material. An improvement of the pressure equation is the setting of the flow stress S equal to a constant K multiplied by the square root of the strain rate D, which is a constant, multiplied by the square root of the strain E which varies during the forming process. Hence, an improvement provides a variable flow stress pressure equation $P=[KD^{\frac{1}{2}}E^{\frac{1}{2}}T_c]/R$. The constant K was found experimentally to be 110000 for Ti-6Al-4V.

As a means to reduce the time of the forming process, the superplastic material is always kept at the maximum strain rate D possible while preventing rupturing or excessive thinning during the forming process. Hence, the strain rate D is equal to the strain E divided by time, $D=E/t=\ln[T_c/T_o]/t$.

Therefore, the curved thickness $T_c$ can be expressed as a function of time t, $T_c=e^{Dt}T_o$. Radius and thickness equations of the model provides that the radius R and curved thickness $T_c$ are equal to a function of a length L, a width W, and a height H dimensions and other model dimensions with at least one dimension varying with time during each stage of the forming process.

Since the thickness $T_c$ and the strain E are a function of time, and since a corresponding varying dimension of the radius equation provides for a corresponding varying radius value, the gas pressure P can be calculated as a function of time.

The gas pressure versus time profile P(t) may be computed as follows. Time is broken down into differential steps dt. Over the differential time dt, the curved thickness $T_c$ changes by a differential thickness $dT_c$. A differential change in a varying die cavity dimension dx can be computed from the curved thickness equations which relate the curved thickness $T_c$ to the die cavity geometry. Given dx, a differential change in the radius dR can be calculated from the radius equations which relate the radius R to the die cavity geometry. Given dt, $dT_c$, dR and the gas pressure equation, a differential gas pressure dP can be computed. In this differential manner, the gas pressure versus time profile P(t) can be computed in differential time steps through time segments $t_1$ through $t_5$.

Computing the pressure versus time profile P(t) or curved thickness $T_c$ is improved by incorporating die friction effects into the curved thickness equations. A differential volumetric portion $V_d$ of the touching volume $V_t$ of material touching the die cavity will flow into the curved volume $V_c$ of the spherically suspended material.

The differential volumetric portion $V_d$ of the touching volume $V_t$ is equal to another constant f multiplied by the curved thickness $T_c$ of the spherically suspended material multiplied by the circumferential or linear perimeter M. The perimeter M is that total distance on the die cavity surface where touching material connects to the spherically suspended material. Hence, $V_d = fT_cM$, where the constant f was found experimentally to be 0.07 for Ti-6Al-4V.

The curved volume $V_c$ of the spherically suspended material 32 is mathematically increased by the differential volume $V_d$ during the forming process. Generally, the curved volume $V_c$ decreases as the touching volume $V_t$ increases during the forming process. The curved thickness $T_c$ is a function of time and the initial thickness $T_o$ expressed as $T_c = e^{Dt}T_o$. Integration over time continually differentially updates and increases the curved volume $V_c$ of the spherically suspended material 32 while correspondingly differentially decreasing the touching volume $V_t$.

The curved thickness $T_c$ of the spherical suspended material 32 can be computed as $T_c = [A_oT_o - V_t]/A_c$ where $A_c$ is the area of the suspended material 32. The curved thickness $T_c$ can be computed at any time during the forming process with an adjustment for the differential volume $V_d$ added to the curved volume $V_c$. In this manner, the curved thickness $T_c$ of the spherically suspended material 32 can be recomputed. Therefore, the minimum thickness which is the curved thickness $T_c$ can also be recomputed at all times during the forming process.

The topography of any particular die cavity is assumed and approximated to be a rectangular box having a box cavity defined by a bottom, four side walls, a height H, a width W and a Length L. The length L is considered a normalizing dimension. A shallow box shape and a deep box shape are used depending on which more closely approximates the actual shape of a corresponding die cavity. A shallow box is defined when the width W divided by the height H is greater than two. A deep box is defined when the width W divided by the height H is less than two.

During the forming process, computation of the curved thickness $T_c$ and gas pressure P occurs in stages using two sets of equations developed for each of the two different box shapes. One set of equations computes the curved thickness $T_c$. The other set of equations computes the radius R of the sphere expanding into the box cavity. The thickness and radius equations are derived from the spherical models.

Each set of equations comprises five separate equations corresponding to five stages $t_1$ through $t_5$ which sequentially occur during the forming process. Each stage is defined by the box and model dimensions and defined by the extent to which the material, that is the model, penetrates the box cavity. The gas pressure P as a function of time can be computed based upon the radius and thickness equations.

To determine the radius R of the spherically suspended material 32 penetrating the box cavity, different spherical models are used in stages depending on the extent of penetration corresponding to the five different time segments $t_1$ through $t_5$.

The stages are defined by when the deforming material 22 touches the bottom, side walls, two dimensional corners or three dimensional corners. The bottom of the box has four commonly understood corners which are referred to as three-dimensional corners and which are eventually and lastly filled by the deforming superplastic material by the very end of the forming process, that is, at the end of time segment $t_5$. These four three-dimensional corners are at the bottom of the box cavity. Each of four three-dimensional corners is formed by two orthogonally connecting adjacent side walls orthogonally connecting to the bottom.

The box bottom also has four two dimensional corners. A two dimensional corner is defined by the center point along a bottom edge and side wall connecting corner. This center point is the midpoint between two adjacent three dimensional corners. A two-dimensional corner is formed by virtue of a side wall orthogonally connecting to a respective edge of the bottom.

In the case of the shallow box, the five different stages are ($t_1$) from a planar sheet metal on top of the box cavity to when the spherical material touched the center of the bottom of the box, ($t_2$) to when the material touches simultaneously all four side walls, ($t_3$) to when the side wall touching material touches the bottom touching material at the two dimensional corners thereby forming, in the box, four spatial enclosed corners defined by three planes—the bottom and two adjacent side walls—and the spherically curved material, at which touching, a one dimensional distance along one direction to the material is longer than the other two dimensional distances in the other two directions, which two dimensional distances are equal, ($t_4$) to when the three dimensional distances from the three dimensional corner to material along all three directions are equal, and ($t_5$) to when the material simultaneously touches and fills in all four three-dimensional corners to a final corner radius $R_c$.

In the case of the deep box, the five different stages are ($t_1$) from a planar sheet metal on top of the box cavity to when the material touches simultaneously all four side walls, ($t_2$) to when the spherical material touched the center of the bottom of the box, ($t_3$) to when the side wall touching material touches the bottom touching material at the two dimensional corners thereby forming, in the box, four spatial enclosed corners defined by three planes—the bottom and two adjacent side walls—the spherically curved material, at which touching, a one dimensional distance along one direction to the material is longer than the other two dimensional distances in the other two directions, which two dimensional distances are equal, ($t_4$) to when the three dimensional distances from the three dimensional corner to material along all three directions are equal, and ($t_5$) to when the material simultaneously touches and fills in all four three-dimensional corners to the final corner radius $R_c$.

Figure 3:
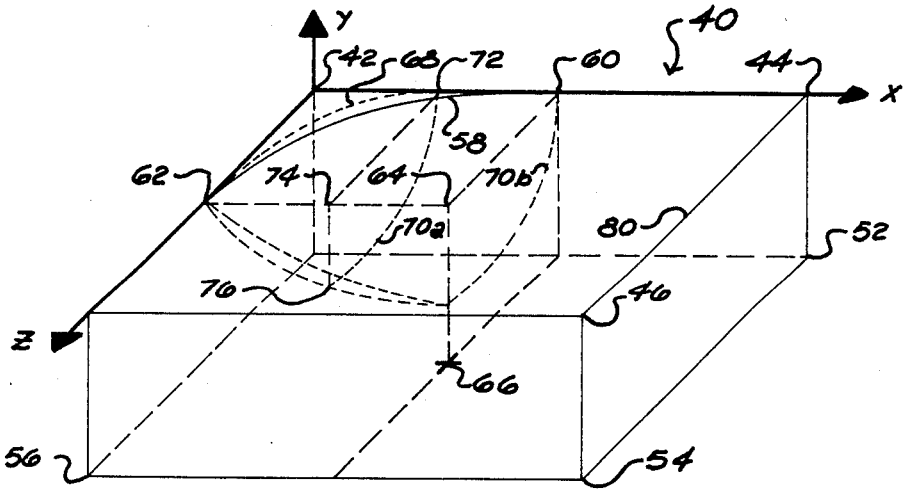
FIG. 3 depicts a spherical model during stage 1.

Referring to FIG. 3, three dimensional axes X, Y and Z position a rectangular box 40 defined by a top having points 42, 44, 46 and 48 and defined by a bottom having four three-dimensional corners at points 50, 52, 54 and 56. The box has a height, width and length. The height dimension H is along the Y axis. The width dimension is along the Z axis. And, the length dimension is along the X axis. For illustration purposes, only a quarter of a sphere 58 of a spherical model is shown.

The sphere 58 which is tangential to a point 60 and which intersects a point 62, moves through the height dimension intersecting along a vertical center line defined by points 64 and 66. Initially, the radius of the sphere 58 is infinite by virtue of the plane having points 60, 62 and 64. As the sphere penetrates the box, the radius of the sphere decreases.

The thickness equation in stage $t_1$ uses a sphere-cylinder model as an approximate spherical model. The sphere-cylinder model comprises a spherical portion defined by surface 68 and a cylinder portion defined by lines 70*a* and 70*b*. The spherical portion 68 which is tangential to a point 72 and which intersects the point 62, passes through the height dimension intersecting along a vertical line defined by points 74 and 76. The cylinder portion has an axis, not shown, which is parallel to the x axis with the curved surface defined by lines 70*a* and 70*b* tangential to points 70 and 60, respectively.

As the sphere model penetrates the box, stage $t_1$ is terminated when the model touches either the side walls or the bottom of the box depending on whether the box is deep or shallow, respectively.

In the case of a shallow box, the model will first touch the bottom of the box at point 66 thereby terminating stage $t_1$. In the case of a deep box, the model will first touch the side walls at a differential infinitesimal distance directly below the four different points 60, 62, 80 and 82.

Figure 4:
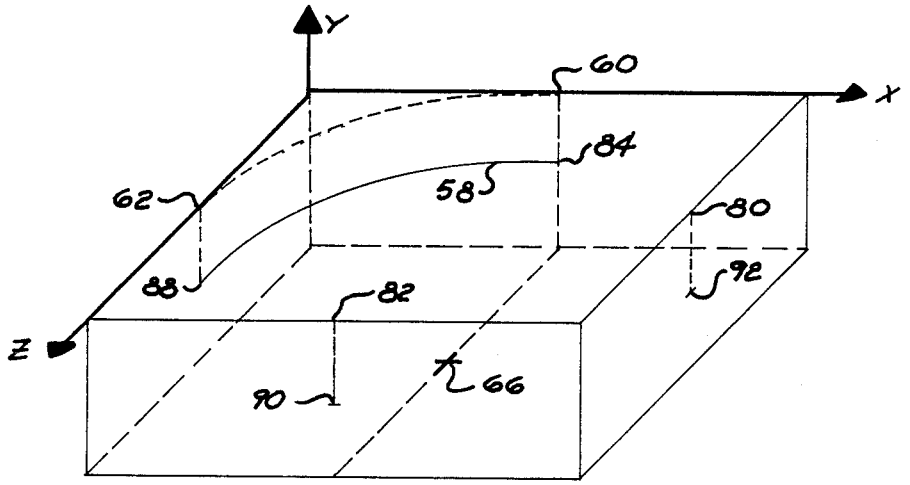
FIG. 4 depicts the spherical model during stage 2 for a deep box cavity.

Referring to FIG. 4, in the case of the deep box during stage $t_2$, the curved surface 58 moves through the height dimension towards the bottom of the box. The curved surface 58, that is the perimeter of the curved surface, moves down the side wall toward the bottom of the box, as illustrated by dash lines between points 60, 62, 80 and 83, and points 84, 88, 92 and 90, respectively. The thickness of the touching portion defined by pints 60, 62, 80 and 82 and by points 84, 88,92 and 90 of the model decreases as the curved surface 58 move through the height dimension until the suspended portion, not shown, touches the bottom at point 66. This movement defines stage 2 for the shallow box.

Figure 5:
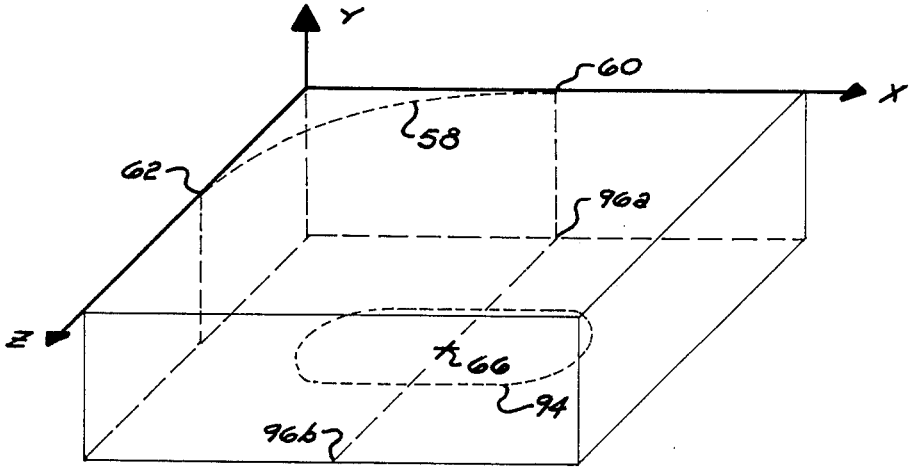
FIG. 5 depicts the spherical model during stage 2 for a shallow box cavity.

Referring to FIG. 5, in the case of the shallow box during stage $t_2$, the model expands and flattens upon the bottom of the box as the model further penetrates the box. As the model expands upon the bottom of the box, the thickness of the material decreases from the center point 66 to the perimeter 94. This movement defines stage 2 for a shallow box. Stage $t_2$ continues until the touching portion curve surface 58 touches the side walls below points 60 and 62.

Referring to FIGS. 4 and 5, stage $t_2$ has touching portions of the model touching the side walls or bottom of the deep box or shallow box, respectively. Both box shapes provide for a perimeter between the touching portion and the suspended portion of the model. This perimeter is used to compute the differential volume portion $V_d$ that is continually differentially subtracted from the touching volume $V_t$ and added to the curved volume $V_c$.

For the deep box depicted in FIG. 4, stage $t_2$ terminates when the curved surface finally touches the bottom at point 66. For the shallow box depicted in FIG. 5, stage 2 terminates when the curve surface 58 starts to touch the side walls below the points 62 and 60.

Figure 6:
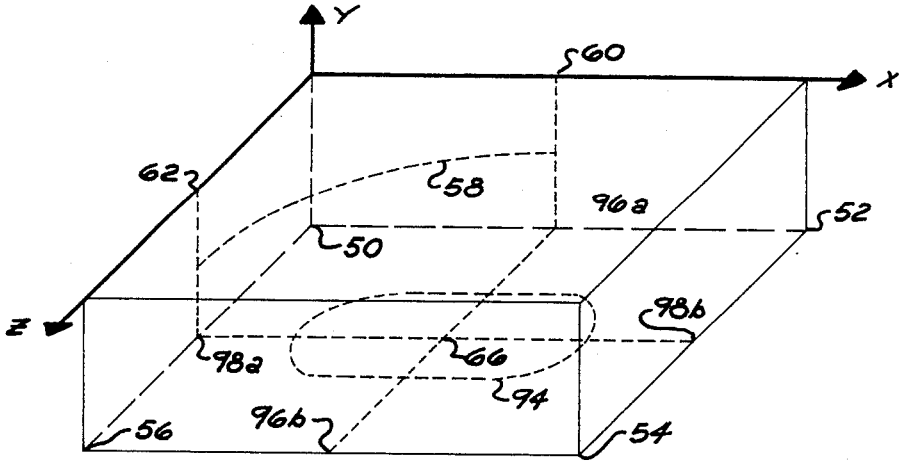
FIG. 6 depicts the spherical model during stage 3.

Referring to FIG. 6 which depicts stage $t_3$ movement, the perimeter 94 on the bottom of the box begins to expands in the case of the deep box or continues to expands in the case of the shallow box. The curve surface 58 begins to move downward in the case of a shallow box or continues to move downward in the case of a deep box through the height dimension.

During stage $t_3$, the curved surface 58 on the side walls continues to move downward through the height dimension as the perimeter 94 expands until the side wall touching portion of the model and the bottom touching portion of the model touch at the two dimensional corners 96 and 98. When the side wall touching portion and the bottom touching portion touch at the two dimensional corner a spatial corner is formed in each of the corners 50, 52, 54 and 56.

Figure 7:
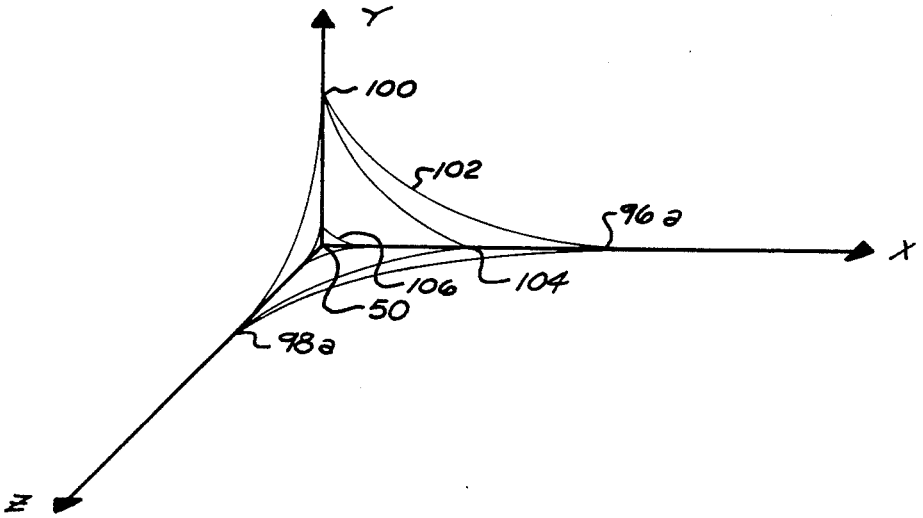
FIG. 7 depicts the spherical model during stages 4 and 5.

Referring to FIG. 7, spatial corners are formed by virtue of space remaining in the box corners at the end of stage $t_3$. The space is defined by the two dimensional corner point 98*a*, the corner point 50, a height point 100 and the surface 102 of a remaining suspended portion of the model.

The distance between the corner point 50 and the point 100 equals the distance between the corner point 50 and the point 98*a*. But, both of these distances are less than the distance between the two dimensional corner point 96*a* and the corner point 50.

During stage $t_4$ the volume of the spatial corner decreases while directional distance between the corner 50 and the two corner point 96*a* decreases along the x axis to point 104. Stage $t_4$ terminates when the distance from the corner 50 to the point 104 equals the directional distance between the corner point 50 and points 98*a* or 100.

During stage $t_5$ the volume of the corner spatial area continues to decrease by virtue of a decreasing distance between the corner point 50 and the three directional distances along the X, Y and Z axes to a final predetermined corner radius $R_c$ depicted by surface 106.

Referring to FIGS. 8 and 9, the radius R and curved thickness $T_c$ equations are provided for each stage $t_1$ through $t_5$ and for each of the two box shapes. Each equation is dependent upon the spherical model and the box geometry. In the case of curve thickness $T_c$ equations, the thickness equations are express in term of a thickness ratio of either $T_c/T_o$ or $T_c/T^*$ where $T_o$ is the initial thickness and where $T^*$ is the ending thickness of the previous stage.

In equations for stage $t_1$, a varying height dimension h varies between 0 and the height H for a shallow box. The varying height dimension h varies between 0 and the W/2, for the deep box.

In equations for stage $t_2$, a varying dimension v varies between point 66 and point 96 and varies between 0 and the difference of [W/2]−H, correspondingly, for the shallow box. The varying dimension v varies between point 60 and point 84 and varies between 0 and [H−W/2], correspondingly, for the deep box.

In equations for stage $t_3$, a varying dimension r varies between the bottom perimeter 94 and a two dimensional corner point 96*a*, and varies between 0 and [H−W/2], correspondingly, for the shallow box. The varying dimension r varies between the center point 66 and the two dimensional corner point 96*a*, and varies between 0 and [W/2], correspondingly, for the deep box.

In equations for stage $t_4$, the varying dimension m varies between the two dimensional corner 96a and point 104, and varies between 0 and [L/2−W/2], correspondingly, for the deep box. The varying dimension m varies between the two dimensional corner point 96a and point 104, and varies between 0 and [L/2−H], correspondingly, for the shallow box.

In equation for stage $t_5$, a varying dimension x varies between point 104 and the curved surface 106 on the x axis, and varies between 0 and $[W/2-R_c/2^{\frac{1}{2}}]$, correspondingly, for the deep box. The varying dimension x varies between point 104 and the curved surface 106 on the x axis, and varies between 0 and $[H-R_c/2^{\frac{1}{2}}]$, correspondingly, for the shallow box.

These radius and thickness equations are used to compute an accelerated pressure versus time profile so as to process formed part is a minimum amount of time without rupturing or excessive and variable thinning. The equations incorporate die frictional effects by the use of the constant f. The equations relate to a three dimensional spherical model penetrating the box cavity which is an approximation of a three dimensional die cavity.

Other particular three dimensional models and modifications may be conceived and used by those skilled in the art. Those models and modifications may nevertheless represent applications and principles within the sprit and scope of the instant invention as defined by the following claims.

What is claimed is:

1. A method for forming superplastic material in a gas pressurized die having a die cavity defining a topography, said method is partitioned into a plurality of stages corresponding to differing extensions of said material into said die cavity, comprising determining one of a plurality of rectangular box shapes models which more closely reflects the shape of said die cavity, analytically modeling in three dimensions the die cavity to one of said plurality of rectangular box shapes having a height, width and length, analytically modeling a plurality of three dimensional shapes of the superplastic material as said superplastic material deforms into a part defined by said die cavity topography, each of said plurality of three dimensional shapes corresponds to a respective one of said stages, determining radius equations based upon spherical models penetrating said die cavity, each of said radius equation is based upon spherical models penetrating said die cavity, each of said radius equations corresponds to a respective one of said stages, determining thickness equations based upon said spherical models penetrating said die cavity, each of said thickness equations is based upon spherical models penetrating said die cavity, each of said thickness equations corresponds to respective said stages, determining a gas pressure versus time profile comprising determining the pressure versus time profile for each of a plurality of time segments each of which corresponds to a respective one of said stages, heating said superplastic material to above one-half of the melting point of said superplastic material whereby said superplastic material exhibits superplastic properties, and applying gas pressure pursuant to said gas pressure versus time profile, said gas pressure is applied against said superplastic material forcing said superplastic material into said die cavity thereby forming said part defined by said cavity topography.

2. The method as in claim 1 in which said plurality of rectangular box shapes include a shallow box shape, and a deep box shape.

3. The superplastic forming method of claim 1 wherein said step of modeling in three dimension the shape of said superplastic material in three dimensions comprises the steps of, determining radius equations based upon spherical models penetrating said die cavity, each of said radius equation is based upon spherical models penetrating said die cavity, each of said radius equations corresponds to a respective one of said stages, and determining thickness equations based upon said spherical models penetrating said die cavity, each of said thickness equations is based upon spherical models penetrating said die cavity, each of said thickness equations corresponds to respective said stages.

4. The method as in claim 3 in which the thickness equations compute the minimum thickness of said superplastic material having a radius determined by a respective one of said radius equations.

5. The superplastic forming method of claim 1 wherein said step of determining a gas pressure versus time profile comprises the steps of, computing a thickness of a spherical portion of said superplastic material, computing a radius of a spherical portion of said superplastic, and computing in differential steps and in said stages the pressure versus time profile based upon said modeling in three dimensions said die cavity and based upon said modeling in three dimensions said superplastic material as said superplastic material deforms into said part defined by said die cavity topography.

6. The superplastic forming method of claim 1 wherein said applying gas pressure pursuant to said gas pressure versus time profile forces said superplastic material into said die cavity at a maximum constant strain rate and at a maximum strain thereby forming a part defined by said cavity topography in the shortest possible time without rupturing or excessive thinning.

7. A superplastic forming method for superplastic material in a gas pressurized die having a cavity defining a topography, comprising the steps of analytically modeling in three dimensions the die cavity, modeling in three dimensions the shape of said material as said material deforms into a part defined by said topography by determining radius equations based upon spherical models penetrating said die cavity, and determining thickness equations based upon said spherical models penetrating said die cavity, determining a gas pressure versus time profile by computing the pressure versus time profile based upon said modeling in three dimensions said die cavity and based upon said modeling in three dimensions said superplastic material as said superplastic material deforms into said part defined by said die cavity topography, heating said material to above one-half of its melting point whereby said superplastic material exhibits superplastic properties, and applying gas pressure pursuant to said gas pressure versus time profile, said gas pressure is applied against said superplastic material forcing said superplastic material into said die cavity thereby forming said part defined by said cavity topography.

8. The superplastic forming method of claim 7 wherein said step of modeling in three dimensions the die cavity comprises the step of modeling the die cavity to a three dimensional rectangular box defined by a height, width and length.

9. A method for superplastic material in a gas pressurized die having a die cavity defining a topography, said method is partitioned into a plurality of stages corresponding to differing extensions of said material into said die cavity, comprising determining one of a plurality of rectangular box shapes models which more closely reflects the shape of said die cavity, analytically modeling in three dimensions the die cavity to one of said plurality of rectangular box shapes having a height, width, and length, analytically modeling a plurality of three dimensional shapes of the superplastic material as said superplastic material deforms into a part defined by said die cavity topography, each of said plurality of three dimensional shapes corresponds to a respective one of said stages, determining radius equations based upon spherical models penetrating said die cavity, each of said radius equation is based upon spherical models penetrating said die cavity, each of said radius equations corresponds to a respective one of said stages, determining thickness equations based upon said spherical models penetrating said die cavity, each of said thickness equations is based upon spherical models penetrating said die cavity, each of said thickness equations corresponds to respective said states, said thickness equations including a die friction effect modeled as a change in volume of a curved portion of said superplastic material, determining a gas pressure versus time profile comprising determining the pressure versus time profile for each of a plurality of time segments each of which corresponds to a respective one of said stages, heating said superplastic material to above one-half of the melting point of said superplastic material whereby said superplastic material exhibits superplastic properties, and applying gas pressure pursuant to said gas pressure versus time profile, said gas pressure is applied against said superplastic material forcing said superplastic material into said die cavity thereby forming said part defined by said cavity topography.

10. A method for forming superplastic material in a gas pressurized die having a die cavity defining a topography, said method is partitioned into a plurality of stages corresponding to differing extensions of said material into said die cavity, comprising the steps of determining one of a plurality of rectangular box shapes models which more closely reflects the shape of said die cavity, analytically modeling in three dimensions the die cavity to one of said plurality of rectangular box shapes having a height, width, and length, analytically modeling a plurality of three dimensional shapes of the superplastic material as said superplastic material deforms into a part defined by said die cavity topography, each of said plurality of three dimensional shapes corresponds to a respective one of said stages, said profile further being based upon a spherical gas pressure equation modified to include a variable flow stress effect, heating said superplastic material to above one-half of the melting point of said superplastic material whereby said superplastic material exhibits superplastic properties, and applying gas pressure pursuant to said gas pressure versus time profile, said gas pressure is applied against said superplastic material forcing said superplastic material into said die cavity thereby forming said pat defined by said cavity topography.

11. A method for forming superplastic material in a gas pressurized die having a cavity defining a three dimensional shape with an opening comprising mounting said material across said opening, heating said superplastic material to a predetermined temperature whereat said material exhibits superplastic properties, applying gas pressure to said material at said opening pursuant to gas pressure versus time profiles to force said superplastic material into said die cavity to conform to said cavity shape, partitioning the method into a plurality of time segments corresponding to stages of differing extensions of said superplastic material into said die cavity under variable pressure by representing said shape by a box model having a height, width, and length, determining a gas pressure versus time profile for each of said time segments by performing a series of distinct computations to obtain values for the radius of curvature, R, and material thickness, $T_c$, as a function of the change is the box model distance parameters for the time segments, each of said computations including factors for depth, width, and length.

adjusting the gas pressure as a function of time in accordance with the profiles so obtained.

12. A method for forming superplastic material in a gas pressurized die having a cavity defining a three dimensional shape with an opening comprising mounting said material across said opening, heating said superplastic material to a predetermined temperature whereat said material exhibits superplastic properties, applying gas pressure to said material at said opening pursuant to gas pressure versus time profiles to force said superplastic material into said die cavity to conform to said cavity shape, partitioning the method into a plurality of time segments corresponding to stages of differing extensions of said superplastic material into said die cavity under variable pressure by representing said shape by a box model having a height, width, and length, determining a gas pressure versus time profile for each of said time segments by performing a series of distinct computations to obtain values for the radius of curvature, R, and material thickness, $T_c$, as a function of the change is the box model distance parameters h, v, r, m, and x, where:

h, the depth dimension increase, v, the spread dimension along bottom of side wall, along a single axis, r, the spread dimension proceeding to all edges, m, the full dimension moving to partially fill all corners equally, x, the distance dimension along edges toward completing filling corners, each of said computations including factors for depth, width, and length, adjusting the gas pressure, p, and the time, t, in accordance with the profiles so obtained.

13. The method as in claim 12 wherein said functions p and t are $p=2KD^{\frac{1}{2}}(ln\ T_c/T_O)^{\frac{1}{2}}(T_c/R)$, and $t=ln(T_c/T_O)/D$.

14. The method as in claim 12 for use with a deep cavity shape in which said determining step is performed according to the following equations:

| STAGE | $\frac{R}{C}$ | DEEP BOX RADIUS AND THICKNESS EQUATIONS |
|---|---|---|
| $t_1$ | R | $R^2=\left(\frac{L^2+W^2}{4W}\right)+\left(\frac{L^2-4h^2}{8h}\right)^2$ |
| $t_1$ | Tc | $\frac{Tc}{To}=\frac{\frac{\pi W^2}{16}+\frac{WL}{4}-\frac{W^2}{4}}{\frac{W^2+4h^2}{8h}\left[\frac{\pi}{2}h+(L-W)\,TAN^{-1}\frac{h}{\frac{W}{2}}\right]}$ |
| $t_2$ | R | $R^2=\left(\frac{L^2+W^2}{4W}\right)^2+\left(\frac{L^2-W^2}{4W}\right)^2=\frac{L^4+W^4}{8W^2}$ |
| $t_2$ | Tc | $\frac{Tc}{T^*}=\left(\frac{\frac{\pi}{2}WL+\pi WV+4(L-W)f}{\frac{\pi}{2}WL+4(L-W)f}\right)^{-\frac{\pi W+2L-2W}{\pi W}}$ |
| $t_3$ | R | $R^2=\left(\frac{W^2+L^2}{4W}\right)^2+\left(r+\frac{L^2-W^2}{4W}\right)^2$ |
| $t_3$ | Tc | $\frac{Tc}{T^*}=\frac{\frac{\pi}{8}WL-\frac{1}{8}\pi r^2-L-\frac{W}{2}r+f(L-W)}{\frac{\pi}{2}\left(\frac{W}{2}-r\right)^2+\frac{\pi^2}{4}r\left(\frac{W}{2}-r\right)+\frac{\pi}{2}\left(\frac{W}{2}-r\right)\frac{L-W}{2}+\frac{\pi Wr}{4}+\frac{1}{8}\pi r^2+\frac{L-W}{2}r+\left(\frac{\pi}{2}r+L-W\right)f}$ |
| $t_4$ | R | $R^2=2\left[\frac{\frac{W^2}{4}+\left(\frac{L}{2}-M\right)^2}{W}\right]^2$ |
| $t_4$ | Tc | $\frac{Tc}{T^*}=\frac{\frac{1}{8}\sqrt{L^2+W^2}\sqrt{\frac{W^2}{4}+\frac{W^2\times L^2}{16(W^2+L^2)}}+\frac{f}{4}\sqrt{W^2+L^2}+f\sqrt{\frac{W^2}{4}+\frac{L^2}{16}}+}{\frac{1}{4}\sqrt{\frac{W^2}{4}+\left(\frac{L}{2}-M\right)^2}\sqrt{\frac{W^2}{4}+\left(\frac{L}{2}-M\right)^2}\sqrt{\frac{W^2}{4}+\frac{W^2\left(\frac{L}{2}-M\right)^2}{16\left[\frac{W^2}{4}+\left(\frac{L}{2}-M\right)^2\right]}}+}$ |

-continued

| STAGE | R/C | DEEP BOX RADIUS AND THICKNESS EQUATIONS |
|---|---|---|
| | | $\dfrac{\frac{W\sqrt{5}}{4}f - \frac{3WM}{32}}{\frac{f}{2}\sqrt{\frac{W^2}{4} + \left(\frac{L}{2} - M\right)^2}} + \frac{W\sqrt{5}}{4}f + \frac{f}{2}\sqrt{W^2 + \left(\frac{L}{2} - M\right)^2} + \frac{3WM}{32}$ |
| $t_5$ | R | $R = \left(\frac{W}{2} - X\right)\sqrt{2}$ |
| $t_5$ | Tc | $\frac{Tc}{T^*} = \left[\dfrac{\left(\frac{W}{2} - X\right) + 13.1\,f}{\frac{W}{2} + 13.1\,f}\right]^{2.58} \dfrac{\frac{W}{2}}{\frac{W}{2} - X}$ |

15. The method as in claim 12 for use with a shallow cavity shape further in which said computations are performed according to the following equations:

| STAGE | R/C | SHALLOW BOX RADIUS AND THICKNESS EQUATIONS |
|---|---|---|
| $t_1$ | R | $R^2 = \left(\frac{L^2 + W^2}{4W}\right)^2 + \left(\frac{L^2 - 4h^2}{8h^2}\right)^2$ |
| $t_1$ | Tc | $\frac{Tc}{To} = \dfrac{\frac{\pi W^2}{16} + \frac{WL}{4} - \frac{W^2}{4}}{\frac{W^2 + 4h^2}{8h}\left(\frac{\pi}{2}h + (L - W)\,TAN^{-1}\frac{h}{\frac{W}{2}}\right)}$ |
| $t_2$ | R | $R^2 = \left(\frac{L^2 + W^2}{4W}\right)^2 + \left(\dfrac{\frac{L^2}{4} - H^2 - V^2 + V\frac{W^2 - L^2}{2W}}{2h}\right)^2$ |
| $t_2$ | Tc | $\frac{Tc}{T^*} = \left(\frac{\pi}{16}W^2 + \frac{\pi}{4}H^2 + \left(\frac{W^2}{8H} + \frac{H}{2}\right)(L - W)\,TAN\frac{2H}{W} - \pi\frac{V2}{8} - V\frac{L - W}{4}\right)\left(\frac{\pi}{2}RH + \frac{\pi^2}{4}RV - \frac{\pi}{2}RV\,SIN^{-1}\frac{R - H}{R} + \dfrac{\left(\frac{W}{2} - V\right)^2 + H^2}{H}\,\frac{L - W}{2}\,TAN^{-1}\dfrac{H}{\frac{W}{2} - V} + \pi\frac{V^2}{8} + V\frac{L - W}{4}\right)^{-1}$ |
| $t_3$ | R | $R^2 = \left(\frac{W^2 + L^2}{4W}\right)^2 + \left(\frac{W^2 + L^2}{4W} - H + r\right)^2$ |
| $t_3$ | Tc | $\frac{Tc}{T^*} = \dfrac{\frac{\pi H^2}{2} + \frac{\pi^2}{4}H\left(\frac{W}{2} - H\right) + \frac{\pi}{4}H(L - W) - \frac{1}{8}\pi\left(\frac{W}{2} - H + r\right)^2 +}{\frac{\pi}{2}(H - r)^2 + \frac{\pi^2}{4}(H - r)\left(\frac{W}{2} - H + r\right) + \frac{\pi}{4}(H - r)(L - W) + \frac{\pi Wr}{4} +}$ |

* * * * *

-continued

| STAGE | $\frac{R}{C}$ | SHALLOW BOX RADIUS AND THICKNESS EQUATIONS |
|---|---|---|
| | | $\dfrac{\frac{1}{8}\pi\left(\frac{W}{2}-H\right)^2-\frac{(L-W)}{2}r+\frac{\pi}{2}\left(\frac{W}{2}-H\right)f+(L-W)f}{\frac{1}{8}\pi\left(\frac{W}{2}-H+r\right)^2-\frac{1}{8}\pi\left(\frac{W}{2}-H\right)^2+\frac{L-W}{2}r+\frac{\pi}{2}\left(\frac{W}{2}-H+r\right)f+(L-W)f}$ |
| $t_4$ | R | $R^2=2\left[\dfrac{\frac{H^2}{4}+\left(\frac{L}{2}-M\right)^2}{2H}\right]^2$ |
| $t_4$ | Tc | $\dfrac{Tc}{T^*}=\dfrac{\frac{1}{8}\sqrt{L^2+16H^2}\sqrt{H^2+\frac{H^2\times L^2}{16^2+L^2}}+\frac{f}{4}\sqrt{16H^2+L^2}+f\sqrt{H^2+\frac{L^2}{16}}+\frac{H\sqrt{5}}{2}f-\frac{3HM}{16}}{\frac{1}{4}\sqrt{4H^2+\left(\frac{L}{2}-M\right)^2}\sqrt{H^2+\frac{{}^2\left(\frac{L}{2}-M\right)^2}{\left[4H^2+\left(\frac{L}{2}-M\right)^2\right]}}+\frac{f}{2}\sqrt{4H^2+\left(\frac{L}{2}-M\right)^2}\cdot\frac{W\sqrt{5}}{4}f+\frac{f}{2}\sqrt{W^2+\left(\frac{L}{2}-M\right)^2}+\frac{3WM}{32}}+$ |
| $t_5$ | R | $R=(H-X)\sqrt{2}$ |
| $t_5$ | Tc | $\dfrac{Tc}{T^*}=\left[\dfrac{(H-X)+13.1f}{H+13.1f}\right]^{2.58}\dfrac{H}{H-X}$ |